US008455071B2

(12) United States Patent
Lo

(10) Patent No.: US 8,455,071 B2
(45) Date of Patent: Jun. 4, 2013

(54) ENVIRONMENT-FRIENDLY FOAMED CONTAINER CLOSURE LAMINATE WITH EMBOSSED TABS

(75) Inventor: Nan-Hu Lo, Sinjhuang (TW)

(73) Assignee: Well-Pack Industries Co., Ltd, Sinjhuang (TW)

( * ) Notice: Subject to any disclaimer, the term of this patent is extended or adjusted under 35 U.S.C. 154(b) by 0 days.

(21) Appl. No.: 12/941,214

(22) Filed: Nov. 8, 2010

(65) Prior Publication Data

US 2012/0111758 A1 May 10, 2012

(51) Int. Cl.
*B32B 5/18* (2006.01)

(52) U.S. Cl.
USPC ..... 428/36.5; 428/35.9; 428/201; 428/343; 428/346; 215/45

(58) Field of Classification Search
USPC .. 428/35.6, 201, 343, 346, 35.9, 36.5; 215/45
See application file for complete search history.

(56) References Cited

U.S. PATENT DOCUMENTS

| | | | | |
|---|---|---|---|---|
| 3,435,977 | A * | 4/1969 | Jacke | 215/255 |
| 4,961,986 | A * | 10/1990 | Galda et al. | 428/201 |
| 5,000,992 | A * | 3/1991 | Kelch | 428/36.5 |
| 5,433,992 | A | 7/1995 | Galda et al. | |
| 5,975,304 | A | 11/1999 | Cain et al. | |
| 6,866,926 | B1 | 3/2005 | Smelko et al. | |
| 6,902,075 | B2 | 6/2005 | O'Brien et al. | |
| 7,169,418 | B2 * | 1/2007 | Dalton et al. | 426/110 |

FOREIGN PATENT DOCUMENTS

| | | |
|---|---|---|
| AU | 641151 | 9/1990 |
| AU | 717579 | 3/2000 |
| EP | 1445209 | 8/2004 |
| TW | M288625 | 3/2006 |
| TW | M297931 | 9/2006 |
| TW | 200706462 | 2/2007 |
| TW | M308274 | 3/2007 |
| TW | I284616 | 8/2007 |
| TW | 200800737 | 1/2008 |
| TW | M384845 | 7/2010 |
| WO | WO/03/066465 | 8/2003 |
| WO | WO/2006/ 073777 | 7/2006 |
| WO | WO/2006/099260 | 9/2006 |

* cited by examiner

*Primary Examiner* — Gwendolyn Blackwell
*Assistant Examiner* — Yan Lan
(74) *Attorney, Agent, or Firm* — McGlew and Tuttle, P.C.

(57) ABSTRACT

An environment-friendly foamed container closure laminate with embossed tabs is composed of, from top to bottom, a stiff polymer printing layer—the top surface of a half thereof is embossed, the bottom surface is printed; a stiff polymer reinforcement layer—its half bottom surface is embossed and the stiff polymer printing layer laminated with the stiff polymer reinforcement layer is used as a tab (if no printing is necessary, the stiff polymer printing layer and the stiff polymer reinforcement layer are combined to be a tab layer); a soft polymer foam layer—used as a sealing gasket; a high melting point polymer isolation layer—to insulate the heat transfer from the electromagnetic induction heated metal layer to the soft polymer foam layer; an electromagnetic induction heatable metal layer; and a peelable thermosensitive adhesive layer.

9 Claims, 7 Drawing Sheets

The present inventive 6-layer structure of the foamed container closure with embossed tabs.

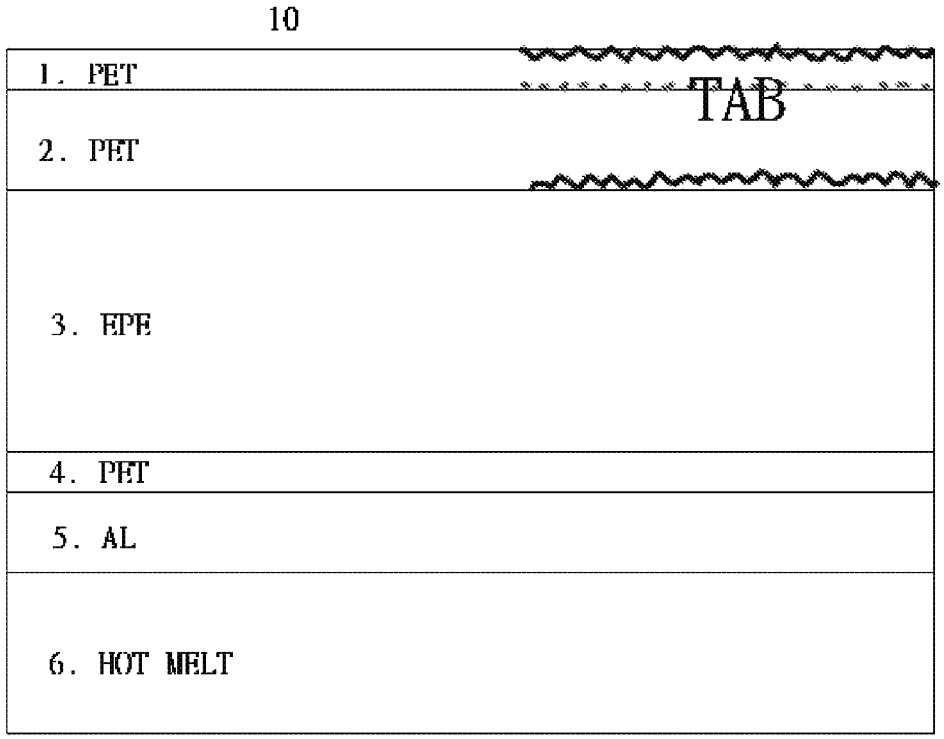
Fig. 8 The present inventive 6-layer structure of the foamed container closure with embossed tabs.

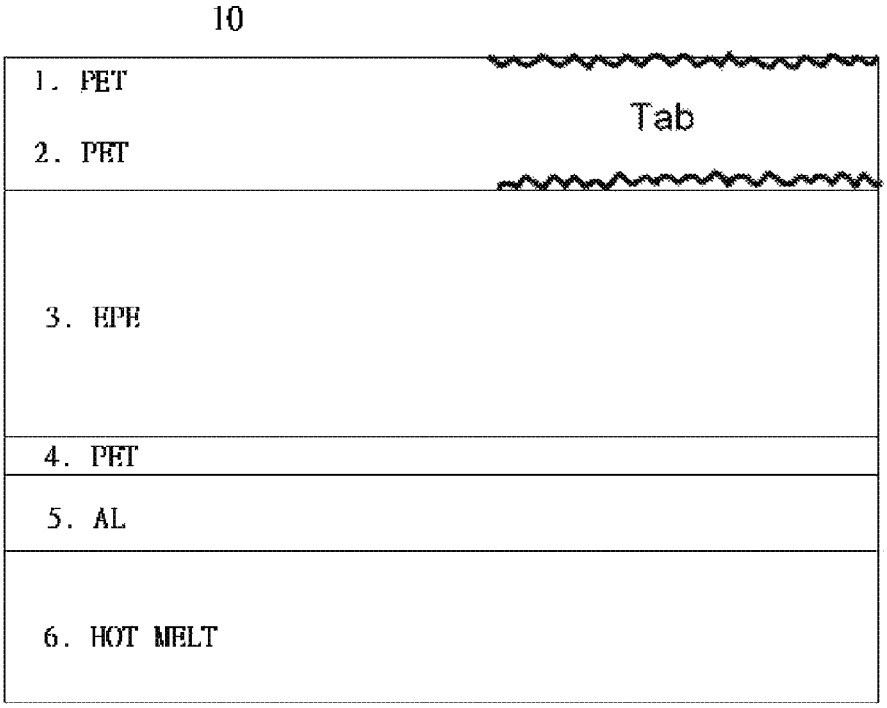
Fig. 9 The present inventive 5-layer structure of the foamed container closure with embossed tabs.

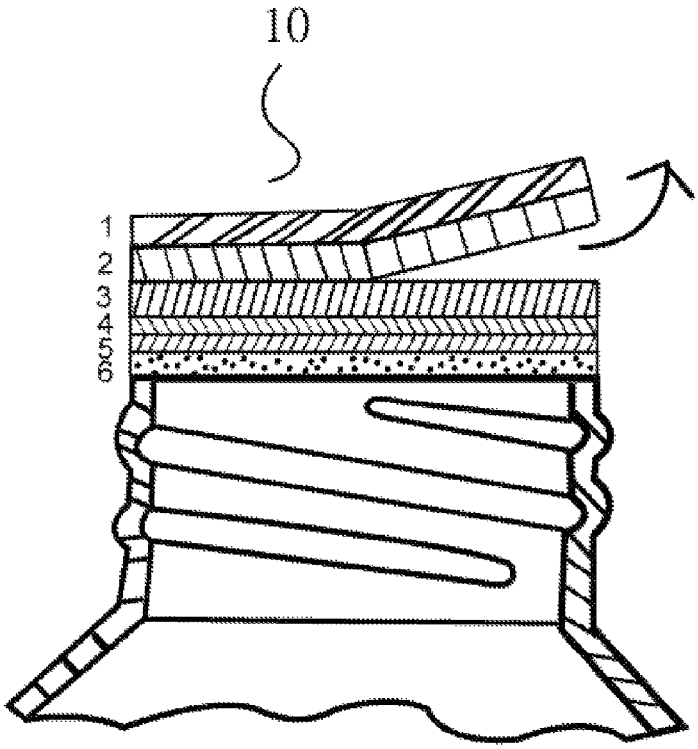
Fig. 10 The application of the the inventive foamed container closure with embossed tabs on the bottle.

ENVIRONMENT-FRIENDLY FOAMED CONTAINER CLOSURE LAMINATE WITH EMBOSSED TABS

FIELD OF THE INVENTION

The present invention relates to a foamed container closure laminate with embossed tabs, in other words, in the container closure with embossed tabs can be produced environment-friendly without organic solvents.

BACKGROUND ART

On Oct. 9, 1990, a container closure with tabs was first introduced by Galda; Michael P. et al. of Canadian Stanpac company. Disclosed as U.S. Pat. No. 4,961,986, with reference to FIG. 1, and "Top Tab" was the registered trademark, but the patent has expired now. Similar AU641151 was also expired. Therefore, the basic container closure structure with tabs is a conventional technology.

Galda, Michael P. et al. also proposed U.S. Pat. No. 5,433,992 on Jul. 18, 1995, wherein the use of a paper peel layer on the top tab was revealed, with reference to FIGS. 2 and 3. However, the release paper is sensitive to moisture exposure, and in particular the problems tied to uneven heating during the heat sealing step. Because the heat dispersion during sealing is uneven on the tab side and on the non-tab side, the heating of the thermo-sensitive adhesive is uneven.

On Aug. 25, 1998, JOSEPH SMELKO et al. of Canada Unipac Company proposed U.S. Pat. No. 5,975,304, which is equivalent to Australian Patent No. 717,579, ethylene-vinyl alcohol copolymer (EVOH) is used as both gas barrier and thermo-sensitive adhesive layer, also a stripping layer is added, with reference to FIG. 4.

On Feb. 7, 2003, JOSEPH SMELKO et al. ILLINOIS TOOL WORKS applied WO/2003/066465, or U.S. Pat. No. 6,902,075, titled "Container Closures", revealed the use of nitrocellulose as the release layer material, and coated with silicone compounds as a release agent, with reference to FIG. 5.

U.S. Pat. No. 6,866,926, i.e. WO/2006/073777, titled "PULL-TAB SEALING MEMBER WITH IMPROVED HEAT DISTRIBUTION FOR A CONTAINER", disclosed by Smelko, Joseph et al. Illinois Tool Works Company on Dec. 19, 2005, wherein a release strip and a release agent are needed, referring to FIG. 6.

ILLINOIS TOOL WORKS, INC. Smelko, Joseph et al. to applied for ROC Patent Publication No. 200706462 on Mar. 14, 2006, patent title: "CONTAINER CLOSURES", i.e. European Patent 1,445,209, or WO/2006/099260, the trademark is Lift & Peel®, wherein a better leak-proof effect had been achieved with foam layers, referred to FIG. 7. But cellulose acetate propionate (CAP) coated with a solvent isopropanol containing silicone release agent is possessed, the solvent isopropanol emission is of course not environment-friendly. In addition, to avoid the thin PET layer crumpling up, an additional polypropylene layer is affixed to the PET layer, as a result, the laminated sheet structure is very complex. In short, organic solvents used in both the release agent and lamination process have an adverse impact on the environment.

Taiwan Forever Enterprise Company filed ROC patent applications on the following dates: 2005-10-19-ROC Patent No. M288625: Improvement on a sealed membrane structure with pulling tabs; 2005-10-26-ROC Patent No. I284616: Environment-friendly stereotyped laminated aluminum foil and the manufacturing method thereof 2006-02-14-ROC Patent No. M297931: Hidden tab structures; 2006-06-13-ROC Patent Publication No. 200800737: Destructive security closure construction; 2007-03-21-ROC Patent No. M308274: Foam plasticanti-sticking gasket; 2010-03-19-ROC Patent No. M384845: Bottle sealing gasket, but none of them mentions embossed tabs and the novel solvent-free lamination process.

DETAILED DESCRIPTION OF THE INVENTION

The present invention is to overcome the shortcomings of the prior arts, first proposes ENVIRONMENT-FRIENDLY FOAMED CONTAINER CLOSURE LAMINATE WITH EMBOSSED TABS, which shows quite simple construction, and two pioneering undertaking—one is that the tab is embossed, thus exhibits a good touch feeling and not slippeily fallen away, and it will not stick to the soft polymer foam layer, thereby the release paper or the release strip is saved (material saving) and/or the release agent is not necessary (environment-friendly solvent free); the second is that a tradional lamination process or a novel environment-friendly solvent-free dry lamination process is used to combine these 5 or 6 layers (in the later case, it is totally solvent free for whole process).

Particularly, the present invention discloses an environment-friendly foamed container closure lamonate with embossed tabs, which is composed of a soft polymer foam layer used to seal the container; and an embossed tab used to lift the closure. When users need to use the contents of the container, only simply to grasp their fingers and pull on the embossed tab, the whole closure will be lifted up easely, namely, to remove the entire sealing laminated films, and use the contents of the container.

The invention "environment-friendly foamed container closure laminate with embossed tabs" contains a total of six layers, as shown in FIG. 8:

The first layer (top layer, 1 in FIG. 8) is the stiff polymer printing layer to provide printing, the material thereof is PET (polyethylene terephthalate), PP (polypropylene) or HDPE (high density polyethylene), preferably is PET, PET film is divided into two zones, half of the bottom surface thereof is printed, then the whole bottom surface is adhered to the second layer (2 in FIG. 8), thus the printing can never scratch off. The thickness of the first layer lies between about 10 to 50 microns.

The second layer (2 in FIG. 8) is also a stiff polymer reinforcement layer, the material thereof is PET, PP or HDPE, preferably is PET. After the first layer and the second layer are laminated together, the half of the resulted laminate is embossed and used as a tab, then the other half thereof is coated with a polyurethane adhesive and adhered to the third layer (3 in FIG. 8). The thickness of the second layer is in the range of about 30 to 100 microns. The embossing process of the laminate includes to let the laminate go through two printing steel rollers at room temperature, because it is operated at room temperature (without heating), it can save energy. If no printing is needed, the first layer and the second layer can be combined into one layer, thereby the entire lamination possesses only five layers whose structure is more simple, as shown in FIG. 9.

The biggest advantage of the inventive process is that the embossed surface will not stick to the third layer 3, therefore a release paper or a peeling layer is not necessary (material cost saving) and the release agent is not needed, thereby no solvent is used, i.e. it is more environment-friendly.

The third layer (3 in FIG. 8) is a soft polymer foam layer, the material thereof is LDPE (low density polyethylene), LLDPE (linear low density polyethylene), EVA (ethylene-vinylacetate copolymer), HDPE or PP, it is preferably LDPE or a blend of LDPE and a polyolefin mentioned above). In FIG. 8, EPE means an expanded polyethylene. For the application to food packaging, the polyethylene foam film is produced via a blown-film foam extrusion with expansion ratio 1.1 to 5.0 in a ten thousand class clean room. The thickness of the foam polyethylene film ranges from 50 to 400 microns.

The fourth layer (4 in FIG. 8)—a high melting point polymer isolation layer is PET or PP film, it is preferably a PET film, as compared the non-polar EPE, the melting point of PET is 255-256° C., which is much higher than that of polyethylene (only about 105° C.), thereby it can isolate the heat generated by electromagnetic induction on AL (aluminum foil) layer during electromagnetic induction, otherwise temperature will melt the third layer of polyethylene foam (EPE) film. The thickness of the fourth layer is about 10 to 50 micron.

The fifth layer (5 in FIG. 8) is an electromagnetic induction heatable metal layer, such as aluminum (AL also is used as an oxygen gas barrier layer). The foil thickness is about 5 to 100 microns.

The sixth layer (6 in FIG. 8) is a peelable thermosensitive adhesive layer used to seal the container, it is a solvent-free hot melt adhesive (Hot Melt). The peelable thermosensitive adhesive layer is with a thickness of about 10 to 80 microns. The choice of the Hot Melt material depends on the type of the bottle or container material, for example, when a high density polyethylene (HDPE) bottle is concerned, an ethylene-vinyl acetate copolymer (EVA) plus a low melting metallocene polyethylene (m-PE) is used as a base material and blended with a tackifier.

The above-mentioned five or six layers can be piled-up through a traditional solvent lamination process or a novel solvent-free lamination process. Thereafter the resulting laminate can be punched into shapes to fit the containers as shown in FIG. 2.

DESCRIPTION OF THE PREFERRED EMBODIMENT

The invention is described in detail below with reference to numerous embodiments for purposes of exemplification and illustration only. Modifications to particular embodiments within the spirit and scope of the present invention, set forth in the appended claims, will be readily apparent to those of skill in the art.

As an example of an environment-friendly foamed container closure laminate with embossed tabs, a laminated closure structure as follows (from top to bottom) is laminated:

| | |
|---|---|
| The first layer - PET: | 12 micron |
| The second layer - PET: | 50 micron |
| The third layer - EPE: | 150 microns |
| The fourth layer - PET: | 12 micron |
| The fifth layer - AL: | 20 microns |
| The sixth layer Hot Melt: | 45 microns |

Between the every two layers, a solvent-based polyurethane adhesive is used to laminate them together, then the composite material is cured at 45~55° C. and aged for 48~72 hours before the next lamination step. Because of the six-layer structure, five lamination steps are needed, wherein the functional pulling tab layer and the functional sealing layer are the two main structures.

First of all, to add the product written warnings or Logo for the end-user reference, the bottom surface of the first layer is printed, then the first layer and the second layer are laminated together to obtain a structure of the pulling tab with warning or Logo printing.

Second, the resulting pulling tab and the third layer of soft polymer foam film are laminated to obtain a functional pulling tab structure. It is important that adhesive is spread on the smooth side of the second layer bottom, while the embossed side of the second layer bottom has no adhesive, thus the embossed side is not adhered to the third layer, and can be freely pulled up as a tab.

Third, in order to prevent the heat generated by the electromagnetic induction of the fifth layer (aluminum foil) to melt the third layer—EPE, a fourth layer—the high melting point polymer isolation layer is laminated with the fifth layer—AL layer to produce a functional magnetic induction base material.

Fourth steps: The functional magnetic induction base material resulted from third step is laminated with the sixth layer—the peelable thermosensitive adhesive layer to get a functional sealing structure.

Fifth steps: The functional pulling tab structure of the step 2 and the functional sealing structure of step 4 are laminated and punched to produce an environment-friendly container closure with embossed tabs.

Briefly speaking, the production steps is simplified as:

1. PET+PET=>Pulling tab
2. Pulling tab+EPE=>Functional pulling tab structure
3. PET+AL=>Functional magnetic induction material
4. Functional magnetic induction material+Hot Melt=>functional sealing structure
5. Functional pulling tab structure+functional sealing structure=>product, finally punched.

If a two-liquid type polyurethane adhesive is used, then it is a totally solvent-free process, it is cured, cross-linked and bonded at room temperature, no oven is needed, so the machine body is shorter and the laminating process is more simple.

BRIEF DESCRIPTION OF THE FIGURES

FIG. 8 shows the structure of the invention 6-layer environment-friendly foamed container closure with embossed tabs . . . ", wherein no release layer is needed.

FIG. 9 shows the structure of the invention 5-layer environment-friendly foamed container closure with embossed tabs . . . ", wherein no release layer is needed.

FIG. 10 shows the application of the invention environment-friendly foamed container closure with embossed tabs . . . " on the bottle.

Figure 1:
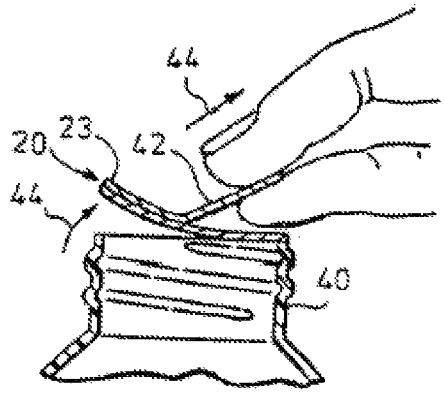
Fig. 1 (prior art)
FIG. 1 (prior art)—the top tap is already a conventional technology, disclosed in U.S. Pat. No. 4,961,986.
Figure 2:
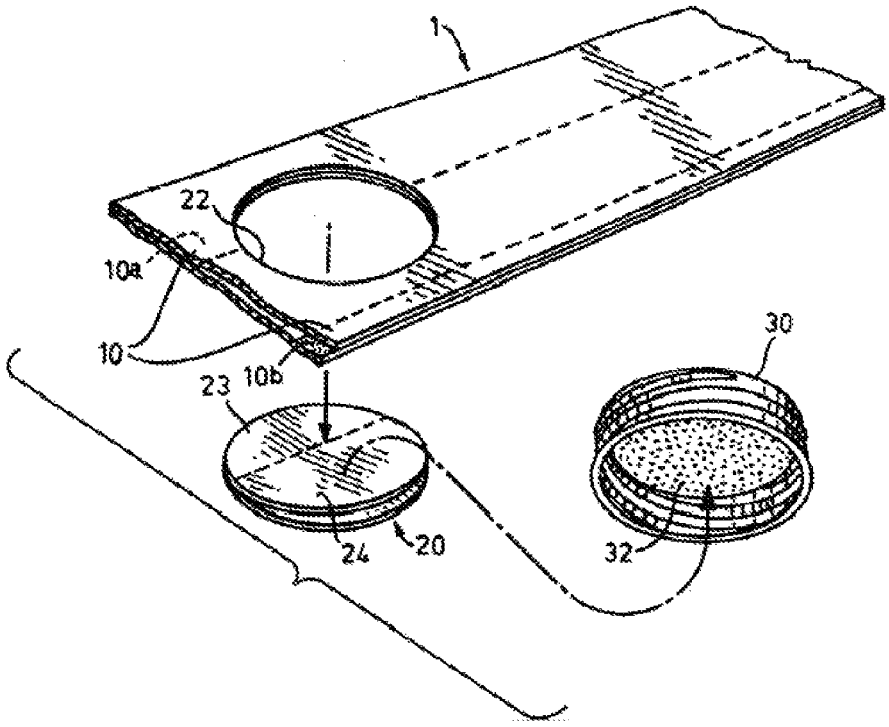
Fig. 2 (prior art)
FIG. 2 (prior art) shows the punching process for a top tap, revealed in U.S. Pat. No. 5,433,992.
Figure 3:
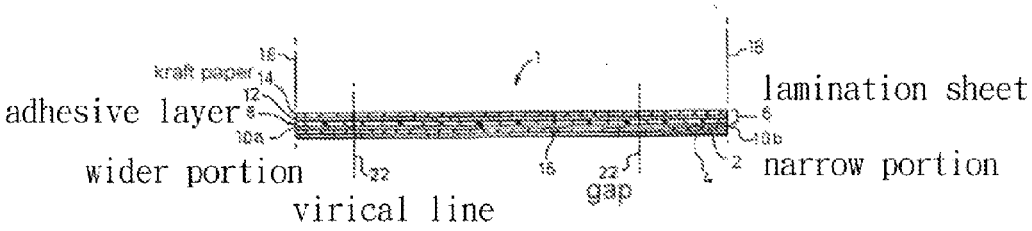
Fig. 3 (prior art)
FIG. 3 (prior art) is the cross section view of the top tap in FIG. 2 wherein a gap is formed after the release strip is withdrawn away—U.S. Pat. No. 5,433,992.
Figure 4:
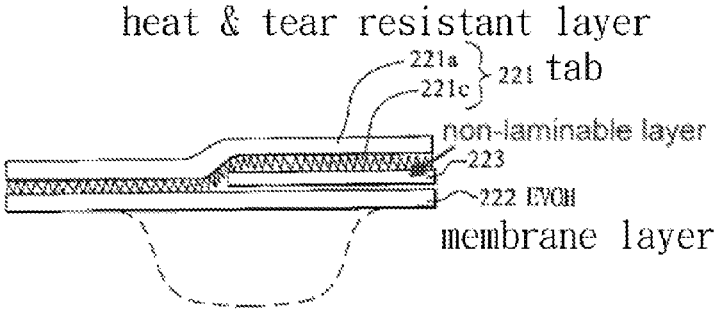
Fig. 4 (prior art)
FIG. 4 (prior art) draws an ethylene-vinyl alcohol copolymer layer used for both oxygen barrier and thermosensitive adhesive layer, wherein a release layer is also added—U.S. Pat. No. 5,975,304.
Figure 5:
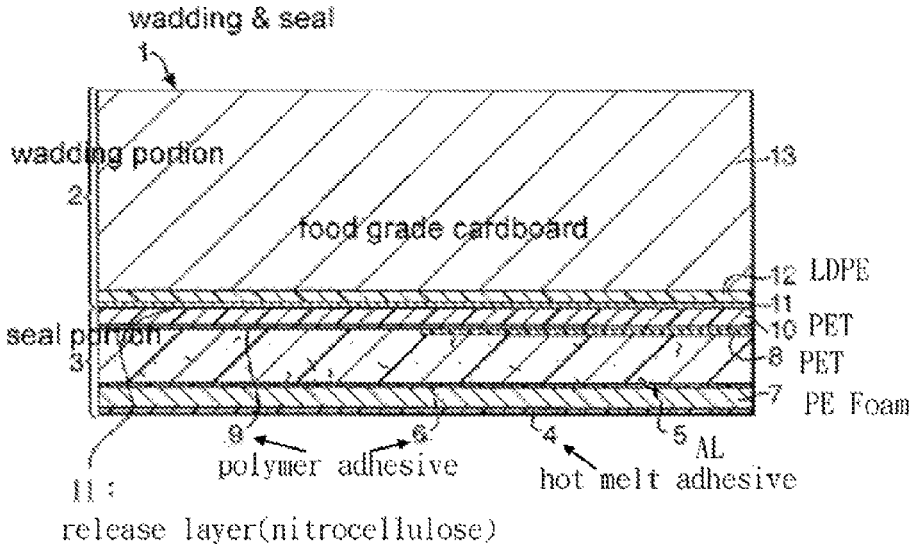
Fig. 5 (prior art)
FIG. 5 (prior art) shows a layer of nitrocellulose applied as the release layer—WO/2003/066465.
Figure 6:
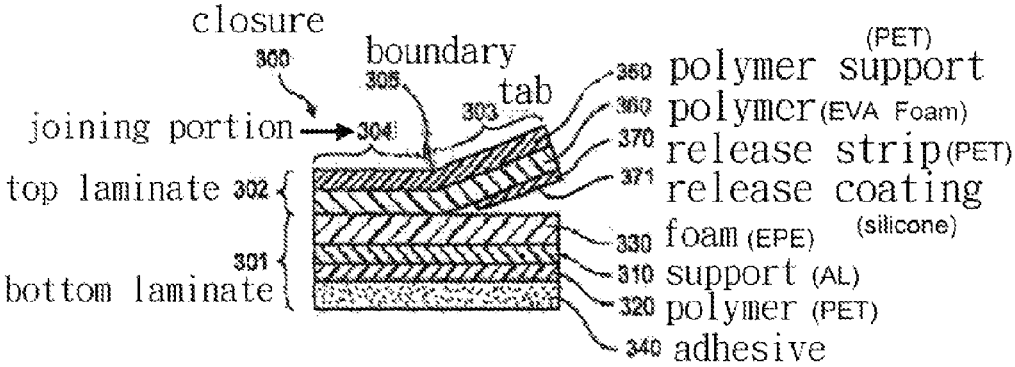
Fig. 6 (prior art)
FIG. 6 (prior art) is a view of the better heat dispersion non-foam layer, disclosed in U.S. Pat. No. 6,866,926, or WO/2006/073777.
Figure 7:
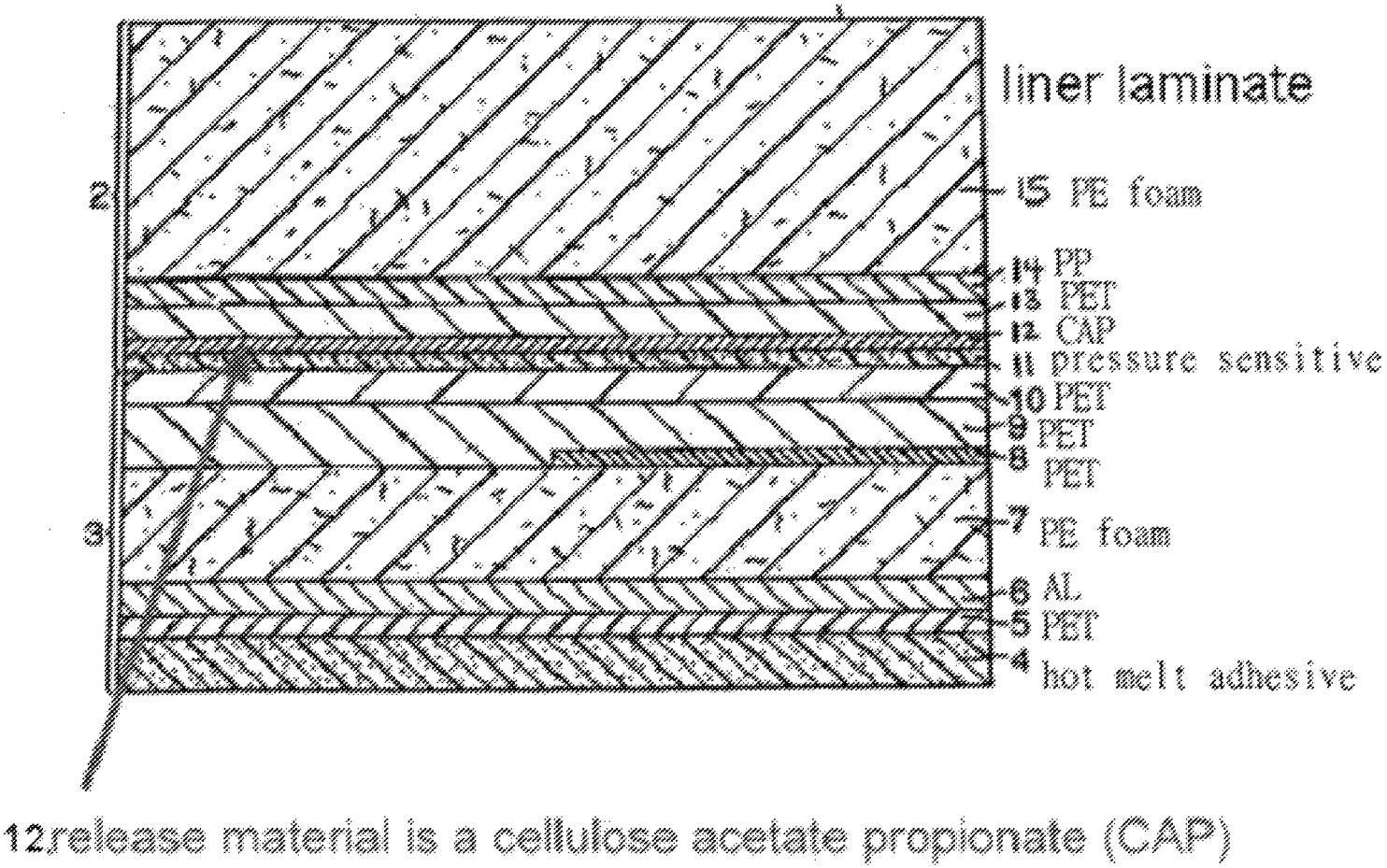
Fig. 7 (prior art)
FIG. 7 (prior art) shows a laminated container closure with a better leak-proof foam layer, and a coated release strip—European Patent EP 1,445,209 or WO/2006/099260.

| THE DESCRIPTION OF MAIN ELEMENTS | |
|---|---|
| PET | a high melting point stiff polymer layer, such as PET (polyethylene terephthalate) film. |
| Tab | a pulling piece |
| EPE | a soft polymer foam layer, such as expanded polyethylene foam (EPE) membrane. |
| AL | an electromagnetic induction heatable metal layer, such as aluminum foil. |
| Hot Melt | a peelable thermosensitive adhesive layer, such as hot melt adhesives |

What is claimed is:

1. An environment-friendly foamed container closure laminate with embossed tabs, comprising:

six layers comprising from top to bottom:

a polyethylene terephthalate printing layer comprising a top surface and a bottom surface, wherein half of said top surface comprises an embossed surface, said bottom surface comprising a printed surface;

a polyethylene terephthalate reinforcement layer comprising a bottom reinforcement layer surface, said polyethylene terephthalate reinforcement layer being in direct contact with said polyethylene terephthalate printing layer, wherein half of said bottom surface comprises an embossed surface, said polyethylene terephthalate printing layer being laminated with said polyethylene terephthalate reinforcement layer to form a laminated polyethylene terephthalate printing layer and reinforcement layer, said laminated polyethylene terephthalate printing layer and reinforcement layer defining a tab;

a soft polymer foam layer defining a sealing gasket, said soft polymer foam layer being in direct contact with said polyethylene terephthalate reinforcement layer;

a polyethylene terephthalate isolation layer in direct contact with said soft polymer foam layer;

an electromagnetic induction heated metal layer, said polyethylene terephthalate isolation layer insulating a heat transfer from said electromagnetic induction heated metal layer to said soft polymer foam layer, said electromagnetic induction heated metal layer being in direct contact with said polyethylene terephthalate isolation layer; and a peelable thermosensitive adhesive layer in direct contact with electromagnetic induction heated metal layer.

2. The environment-friendly foamed container closure laminate with embossed tabs as claimed in claim 1, wherein said soft polymer foam layer is one of low density polyethylene, linear low density polyethylene, ethylene-vinylacetate copolymer, HDPE, PP and a mixture of LDPE and above mentioned polyolefin, and a layer thickness range is 50 to 400 microns and a foaming ratio is 1.1 to 5.0.

3. The environment-friendly foamed container closure laminate with embossed tabs as claimed in claim 1, wherein the electromagnetic induction heatable metal layer is an aluminum foil with a thickness range between 5~100 microns.

4. The environment-friendly foamed container closure laminate with embossed tabs as claimed in claim 1, wherein the peelable thermosensitive adhesive layer is a hot melt adhesive film with a thickness range between 10~80 microns.

5. An environment-friendly foamed container closure laminate with embossed tabs, comprising:

five layers comprising from top to bottom:

a polyethylene terephthalate printing layer, wherein half of one side of said polyethylene terephthalate is embossed to define an embossed side portion, said embossed side portion defining a tab;

a soft polymer foam layer defining a sealing gasket, said soft polymer foam layer being in direct contact with said polyethylene terephthalate printing layer;

a polyethylene terephthalate isolation layer in direct contact with said soft polymer foam layer;

an electromagnetic induction heatable metal layer in direct contact with said polyethylene terephthalate isolation layer, said polyethylene terephthalate isolation layer insulating a heat transfer from the electromagnetic induction heated metal layer to the soft polymer foam layer; and a peelable thermosensitive adhesive layer in direct contact with said electromagnetic induction heatable metal layer.

6. An environment-friendly foamed container closure laminate with embossed tabs, comprising:

a polyethylene terephthalate printing layer comprising a top surface and a bottom surface, at least half of said top surface comprising an embossed surface, said bottom surface comprising a printed surface;

a polyethylene terephthalate reinforcement layer comprising a bottom reinforcement layer surface, said polyethylene terephthalate reinforcement layer being in direct contact with said polyethylene terephthalate printing layer, said polyethylene terephthalate reinforcement layer being located adjacent to said polyethylene terephthalate printing layer, at least half of said bottom surface of said polyethylene terephthalate reinforcement layer comprising an embossed surface, said polyethylene terephthalate printing layer being laminated with said polyethylene terephthalate reinforcement layer to form a laminated polyethylene terephthalate printing layer and reinforcement layer, said laminated polyethylene terephthalate printing layer and reinforcement layer defining a tab;

a soft polymer foam layer, said polyethylene terephthalate reinforcement layer being arranged between said soft polymer foam layer and said polyehtylene terephthalate printing layer, said soft polymer foam layer being in direct contact with said polyethylene terephthalate reinforcement layer;

a polyethylene terephthalate isolation layer located adjacent to said soft polymer foam layer, said polyethylene terephthalate isolation layer being in direct contact with said soft polymer foam layer;

an electromagnetic induction heatable metal layer located adjacent to said polyethylene terephthalate isolation layer, said electromagnetic induction heatable metal layer being in direct contact with said polyethylene terephthalate isolation layer, said polyethylene terephthalate isolation layer being arranged between said electromagnetic induction heatable metal layer and said soft polymer foam layer, said polyethylene terephthalate isolation layer insulating a heat transfer from said electromagnetic induction heatable metal layer to said soft polymer foam layer; and a peelable thermosensitive adhesive layer located adjacent to said electromagnetic induction heatable metal layer, said peelable thermosensitive adhesive layer being in direct contact with said electromagnetic induction heatable metal layer, said electromagnetic induction heatable metal layer being arranged between said peelable thermosensitive adhesive layer and said polyethylene terephthalate isolation layer, said peelable thermosensitive adhesive layer comprising an outer container engaging contact surface for engaging a container.

7. The environment-friendly foamed container closure laminate with embossed tabs as claimed in claim 6, wherein said soft polymer foam layer is one of low density polyethylene, linear low density polyethylene, ethylene-vinylacetate copolymer, HDPE, PP and a mixture of LDPE and above mentioned polyolefin, and a layer thickness range is 50 to 400 microns and a foaming ratio is 1.1 to 5.0.

8. The environment-friendly foamed container closure laminate with embossed tabs as claimed in claim 6, wherein the electromagnetic induction heatable metal layer is an aluminum foil with a thickness range between 5~100 microns.

9. The environment-friendly foamed container closure laminate with embossed tabs as claimed in claim 6, wherein the peelable thermosensitive adhesive layer is a hot melt adhesive film with a thickness range between 10~80 microns.

* * * * *